US005270697A

United States Patent [19]

Takeda

[11] Patent Number: 5,270,697

[45] Date of Patent: Dec. 14, 1993

[54] DISPLAY APPARATUS

[75] Inventor: Makoto Takeda, Nara, Japan

[73] Assignee: Sharp Kabushiki Kaisha, Osaka, Japan

[21] Appl. No.: 540,795

[22] Filed: Jun. 20, 1990

[30] Foreign Application Priority Data

Jun. 30, 1989 [JP] Japan ..... 1-170575

[51] Int. Cl.[5] ..... G09G 3/36

[52] U.S. Cl. ..... 345/96; 345/209

[58] Field of Search ..... 340/784, 805, 789; 350/332, 333; 359/100

[56] References Cited

U.S. PATENT DOCUMENTS

| | | | |
|---|---|---|---|
| 4,525,710 | 6/1985 | Hoshi et al. | 340/784 |
| 4,655,561 | 4/1987 | Kanbe et al. | 359/100 |
| 4,691,200 | 9/1987 | Stephany | 340/709 |
| 4,693,563 | 9/1987 | Harada et al. | 359/100 |
| 4,730,140 | 3/1988 | Masubuchi | 350/333 |
| 4,915,477 | 4/1990 | Ohta et al. | 350/333 |
| 4,922,240 | 5/1990 | DuWaer | 350/333 |
| 4,926,168 | 5/1990 | Yamamoto et al. | 340/805 |

FOREIGN PATENT DOCUMENTS

| | | |
|---|---|---|
| 59-115680 | 4/1984 | Japan . |
| 61-067834 | 8/1986 | Japan . |
| 01106017 | 8/1989 | Japan . |

*Primary Examiner*—Alvin E. Oberley
*Assistant Examiner*—Regina Liang

[57] ABSTRACT

An AC driving type of display apparatus such as a matrix type liquid crystal display apparatus, which is adapted to prohibit the application of the scanning voltage upon at least one of the row electrodes for a given period so as to switch the repetition period of the scanning voltage to be applied on at least one of the row electrodes into the integral multiple of the original repetition period. Further, it is adapted to switch the period of the polarity inversion of the driving voltage to be applied upon the picture element in accordance with the repetition period of the switched scanning voltage. Further, the complete AC driving operation may be effected, for example, even in a case where the signal voltage at the first repetition period of the scanning voltage is different from the signal voltage at the second repetition period.

11 Claims, 7 Drawing Sheets

DISPLAY APPARATUS

BACKGROUND OF THE INVENTION

The present invention generally relates to an AC driving type of display apparatus such as matrix type of liquid crystal display apparatus or the like.

FIG. 7 shows a circuit diagram showing an equivalent circuit of a liquid crystal panel in a liquid crystal display apparatus of an active matrix driving system. Referring to FIG. 7, picture elements Q are arranged respectively in the respective cross positions among a plurality of row electrodes X1, X2, X3, X4, X5 (hereinafter the optional row electrode is shown with a reference character X) arranged in parallel to one another, and a plurality of column electrodes Y1, Y2, Y3, Y4, Y5 (hereinafter the optional column electrode is shown with a reference character Y) arranged in parallel to one another which are orthogonal with respect to the row electrodes X1 through X5. Further the respective picture elements Q are connected with the corresponding column electrodes Y through the switching elements K, and the control terminals of the respective switching elements K are connected with the corresponding row electrodes X.

FIG. 8 is a wave-form chart showing one example of the driving wave forms of the liquid crystal pulses. With reference to the wave-form chart, the driving operation of a picture element Q1i, which is located in the cross position between the row electrode X1 and the column electrode Yi (i=1 through 5) in FIG. 7, will be described hereinafter.

The scanning pulses G1 through G5 are applied sequentially in line respectively upon the respective row electrodes X1 through X5 of the liquid crystal pulse of FIG. 7 as shown in FIG. 8 (1) through (5), with a result that the switching elements K connected with the respective row electrodes X1 through X5 are on, sequentially, one line by one line.

A signal voltage Si to be stored in each picture element corresponding to the column electrode Yi is applied upon the column electrode Yi through the switching element K, as shown in FIG. 8 (6), in the synchronous operation with the scanning pulses G1 through G5.

With the observation of the switching element K connected with a first row electrode X1, the signal voltage Si to be applied upon the column electrode Yi is v1 in a period T1 where the switching element K becomes on with the scanning pulse G1, so that the voltage v1 is stored in the picture element Q1i. Also, since the switching element K becomes off at the periods T2 through T5 after the period T1, the voltage v1 previously stored is retained by the liquid crystal capacity of the picture element Q1i during this period. Namely, the applied voltage V1i onto the picture element Q1i is retained as shown in FIG. 8 (7) during the period T1 through T5. At the period T1' when the application of the scanning pulses G1 through G5 onto all the row electrodes X1 through X5 takes a round, then the switching element K connected with the row electrode X1 becomes on again with the scanning pulse G1, the signal voltage Si to be applied upon the column electrode Yi becomes a voltage −V1 opposite in polarity to a case of the period T1, and the voltage −V1 is stored in the picture element Q1i. At the periods T2' through T5' after the period T1', the switching element K becomes off. The applied voltage V1i into the picture element Q1i is maintained into −V1 as shown in FIG. 8 (7) during this period. In this manner, the applied voltage V1i into the picture element Q1i becomes opposite in polarity between a first field F1 of the period T1 through T5 and a second field F2 of the periods T1' through T5', so that the AC rectangular waves are applied upon the picture element Q1i during the period.

As described hereinabove, in the liquid crystal display apparatus of such active matrix driving system, an AC driving operation which inverts, for each of the fields, the polarity of the signal voltage to be applied upon the respective column electrodes Y1 through Y5. This operation prevents the application of the DC voltage upon the liquid crystal, which causes the display quality to be lowered, the crystal to be deteriorated, and so on.

In such a crystal display apparatus as described hereinabove, in order to display the images of, for example, the television broadcasting operation, it is necessary in the above described AC driving operation that the picture signals in the odd-number fields should be in complete conformity with the picture signals at the even-number fields. In the case of the normal television picture signals, it is infrequent that the picture signals of the respective fields are in complete conformity, and it is often the case that the picture signals have fairly strong interrelation among the respective fields, so that the AC driving operation is not largely interfered with.

But when the television images transcribed by, for example, a video tape recorder are displayed, the picture signals of the odd-number fields are extremely different from the picture signals of the even-number fields because of the inconveniences of the reproduction head. Thus, the above described AC driving operation is considerably interfered with. Thus, there is a problem that the display quality is lowered and the liquid crystal is deteriorated.

SUMMARY OF THE INVENTION

Accordingly, an essential object of the preset invention is to provide a display apparatus, which is capable of superior display operation without the interference with the AC driving operation even when the picture signals to be displayed are extremely different between in the odd number fields and in the even number fields.

In accomplishing these and other objects, according to one preferred embodiment of the present invention, there is provided a display apparatus which includes a means for prohibiting the application of the scanning voltage upon at least one of the row electrodes for a given period so as to switch the repetition period of the scanning voltage to be applied on at least one of the row electrodes into the integral multiple of the original repetition period, and a means for switching the period of the polarity inversion of the driving voltage in accordance with the repetition period of the switched scanning voltage.

According to the present invention, when the signal voltage at a first repetition period of, for example, the scanning voltage is different from the signal of a second repetition period, the application of the scanning voltage of at least one of the row electrodes is prohibited in the one repetition period. The application of the driving voltage upon the picture element corresponding to the row electrode prohibited upon the application of the scanning voltage is effected only once in a period twice the repetition period of the original scanning voltage.

Further, the polarity of the driving voltage is inverted with the term being provided as the period. Accordingly, the complete AC driving operation is effected.

BRIEF DESCRIPTION OF THE DRAWINGS

These and other objects and features of the present invention will become apparent from the following description taken in conjunction with the preferred embodiment thereof with reference to the accompanying drawings, in which.

DETAILED DESCRIPTION OF THE INVENTION

Figure 1:
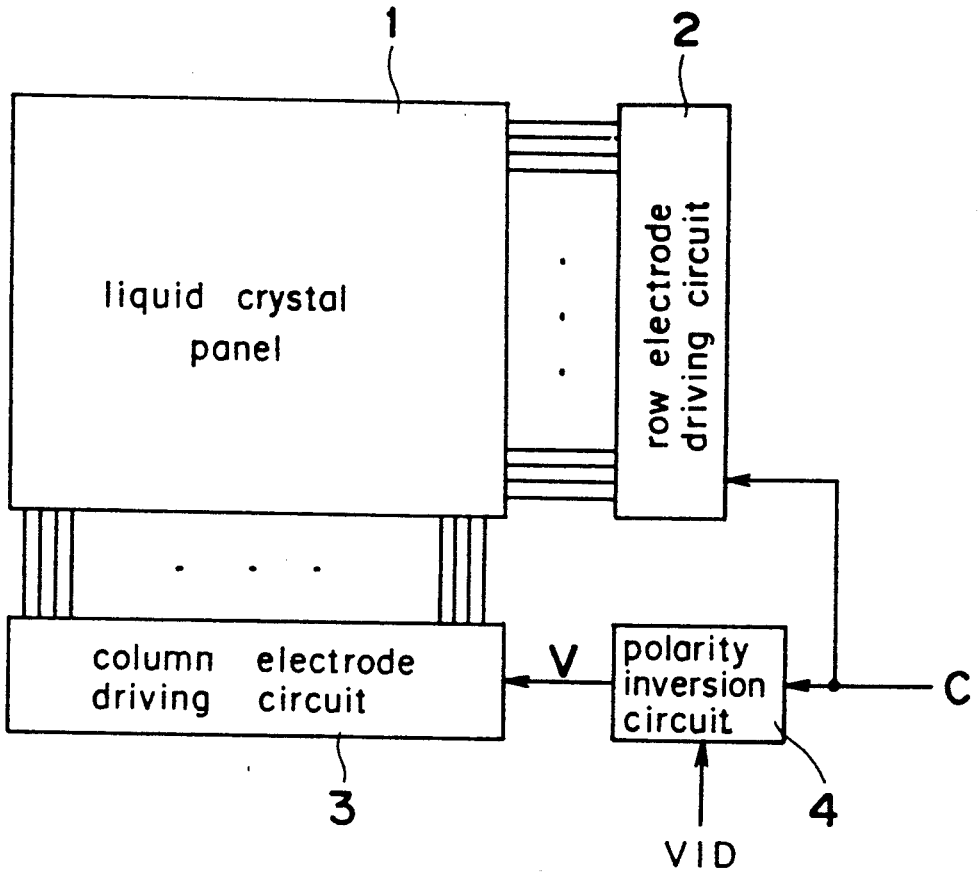
FIG. 1 is a block diagram showing the schematic construction of a display apparatus which is in one embodiment of the present invention.

Before the description of the present invention proceeds, it is to be noted that like parts are designated by like reference numerals throughout the accompanying drawings.

Referring now to the drawings, there is shown in FIG. 1, a block diagram showing the schematic construction of a display apparatus according to one preferred embodiment of the present invention. The display apparatus is a liquid crystal display apparatus of an active matrix driving system, which includes a liquid crystal panel 1 with a plurality of picture elements, not shown, in the matrix shape being arranged; a row electrode driving circuit 2 which is adapted to sequentially apply, in line, the scanning pulses upon a plurality of row electrodes, not shown, to be arranged in parallel to one another along each,row of these picture elements; a column electrode driving circuit 3 for applying, in the synchronous operation with the scanning pulses, the signal voltage corresponding to the display contents of each of the picture elements corresponding to these column electrodes, upon a plurality of column electrodes not shown, to be arranged in parallel to one another along each column of the picture elements; a polarity inversion circuit 4 for inverting the polarity of the picture signals VID to be inputted for a constant period so as to transmit it into the column electrode driving circuit 3 so that a control signal C for prohibiting, for a constant period, the application of the scanning pulses upon all the row electrodes or the partial row electrodes of the liquid crystal panel 1 is given to the above described row electrode driving circuit 2. Also, the control signal C is given even to the polarity conversion circuit 4, and may become a control signal which switches the period of the polarity inversion of the picture signal VID.

The switching elements are respectively provided corresponding to the respective picture elements of the liquid crystal panel 1. The picture elements are connected to the column electrodes through the switching elements. The control terminals of the switching elements are connected with the corresponding row electrodes. The switching elements are turned on by the scanning pulses to be applied upon the row electrodes. The signal voltages from the corresponding row electrodes are adapted to be applied upon the corresponding picture elements through the switching elements. The construction thereof is the same as the conventional liquid crystal display apparatus.

Figure 2:
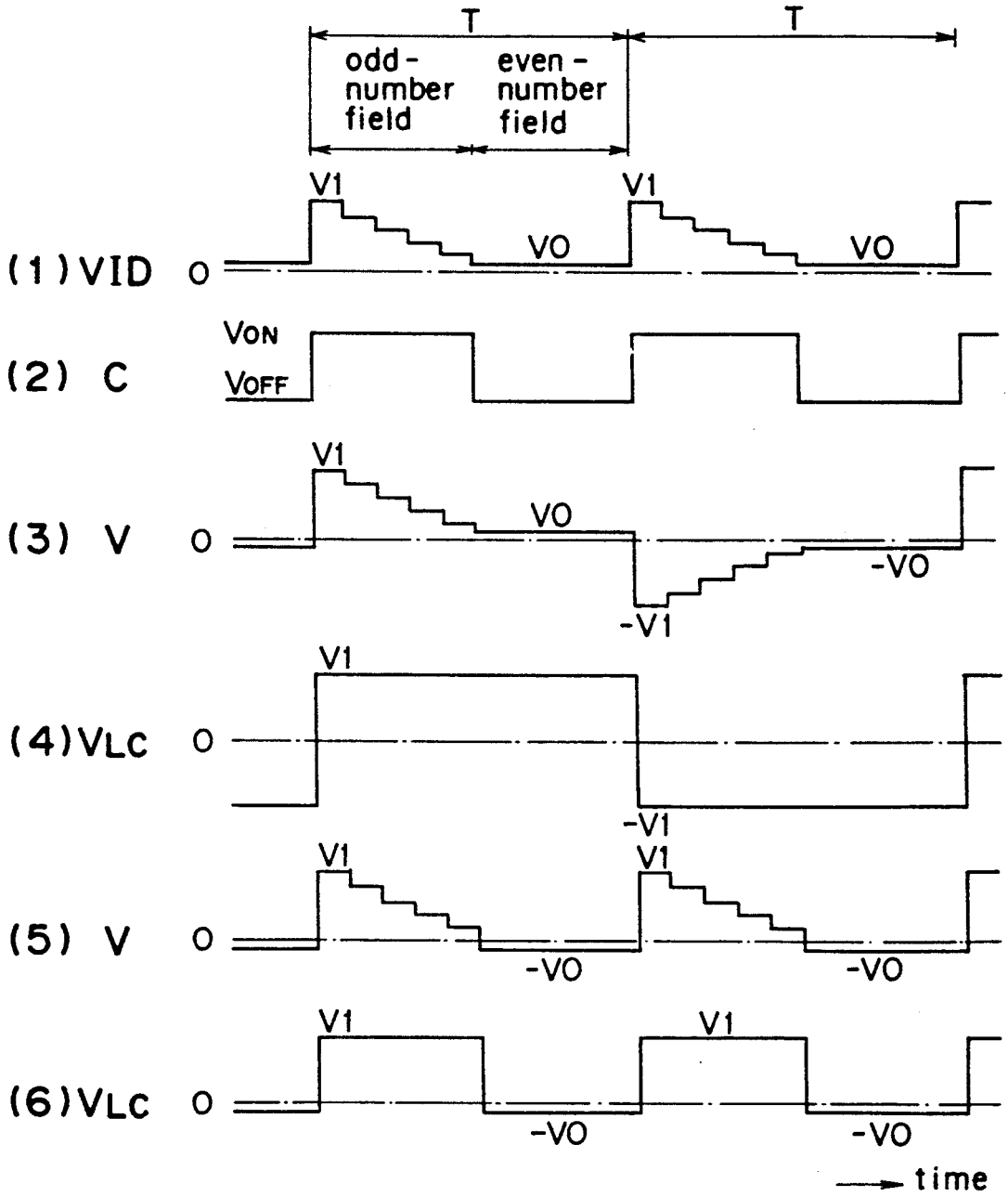
FIG. 2 is a timing chart showing the operation of the display apparatus thereof.

FIG. 2 is a timing chart showing the operation of the above described liquid crystal display apparatus. The operation of the above described liquid crystal display apparatus will be described hereinafter with reference to the timing chart.

As shown in FIG. 2 (1), the picture signals VID, which are completely different in the wave form between the odd-number field, and the even-number field are to be inputted into the polarity inversion circuit 4. Such a picture signal VID is equivalent to a case where the reproduction signal by one head has become noisy in state when the picture signals VID are reproduced from the video tape recorder of two-head system.

At this time, a control signal C, which becomes the voltage Von of the high level in the odd-number field, becomes the voltage Voff of the low level in the even-number field as shown in FIG. 2 (2), is inputted into the row electrode driving circuit 2 and the polarity inversion circuit 4. The scanning pulses are sequentially applied upon all the row electrodes in the odd-number field, and the scanning pulses are not applied upon any row electrodes in the even-number field by the control signal C. In the polarity inversion circuit 4, the polarity of the picture signal VID to be inputted is inverted for each of period T (which is equal to the period of the scanning pulse), with the odd-number field and the next even-number field being added in it as shown in FIG. 2 (3), and is transmitted into the column electrode driving circuit 3 as the signal voltage V.

Accordingly, a voltage v1 corresponding to the applied timing of the scanning pulse into a first row electrode in the odd-number field among the signal voltages V as shown with reference character VLC in FIG. 2 (4) is applied upon the picture element to be located in the cross position between the first row electrode and the column electrode upon which the signal voltage V shown in FIG. 2 (3) is applied. Further, the voltage v1 is retained for the period T. Also, the voltage −v1 corresponding to the applied timing of the scanning pulse into the first row electrode among the signal voltages V inverted in polarity is applied upon the beginning of the next period T, with the voltage −v1 being retained for the next period T.

Since the AC rectangular wave which is inverted in polarity for each period T is applied upon the picture element in this manner, the AC driving is not interfered with.

In a case where the scanning pulses are applied with respect to the respective row electrodes for each of the fields in the row electrode driving circuit 2, with the above described control signal C being not provided, and the polarity of the picture signal VID to be inputted is inverted for each of the respective fields even in the polarity inversion circuit 4, the signal voltage V to be transmitted into the column electrode driving circuit 3 from the polarity inversion circuit 4 becomes different mutually among the respective fields although the polarity is inverted in the odd-number field and the next even-number field as shown in FIG. 2 (5). Accordingly, the voltage VLC to be applied upon the picture element becomes unsymmetrical because of the odd-number field (voltage v1) and the even-number field (voltage-v0) as shown in FIG. 2 (6), so that the AC driving operation is largely interfered with.

Figure 3:
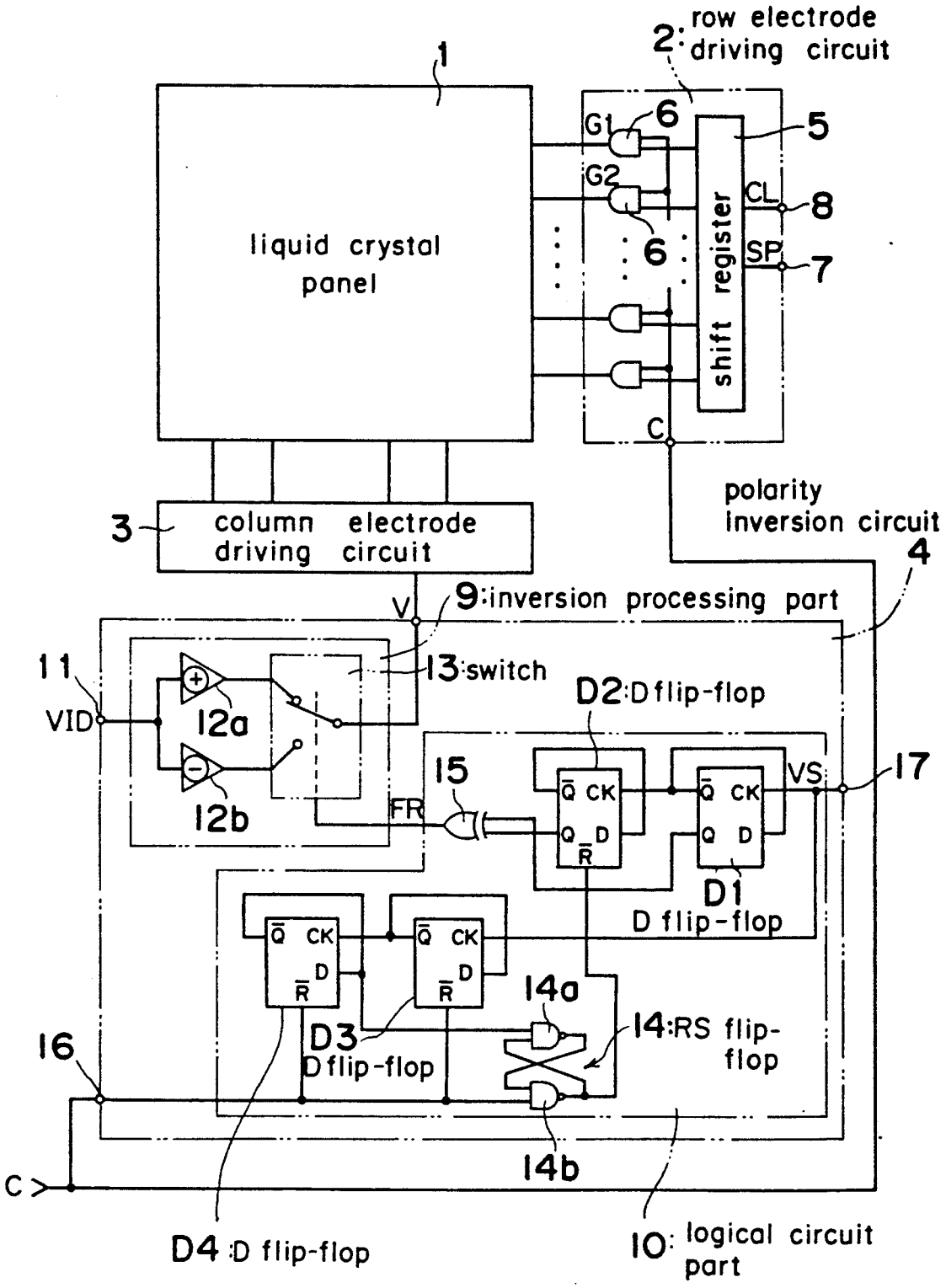
FIG. 3 is a circuit diagram showing one example of a construction of the display apparatus thereof.

FIG. 3 is a circuit diagram showing one preferred circuit construction of the above described embodiment. In FIG. 3, the row electrode driving circuit 2 is composed of a shift register 5 for sequentially selecting in line the respective row electrodes of the liquid crystal panel 1, and an AND gate 6 which selectively prohibits, with a control signal C, the selection signal corresponding to the row electrodes to be outputted from the shift register 5. Namely, the selection signal to be outputted from the shift register 5 is given as one input of the AND gate 6, which has been provided correspondingly to the respective row electrodes, while the control signal C is given as the other one input of the AND gate 6. The outputs G1, G2, . . . of the AND gate 6 are applied as the scanning pulses upon the respective row electrodes.

The shift register-5 sequentially shifts the pulse SP to be given from the terminal 7 by the shift clock CL so as to generate the selection signal.

Also, the polarity inversion circuit 4 is composed of an inversion processing part 9 which inverses the polarity of the picture signal VID to be inputted and a logical circuit part 10 which gives the timing of the inversion operation thereof. The inversion processing part 9 is composed of a non-inversion amplifier 12*a* and an inversion amplifier 12*b* which are connected, respectively with the input terminal 11 to which the picture signal VID is inputted. It further includes a switch 13 which selects either of these amplifiers 12*a*, 12*b*, so as to transmit it into the column electrode driving circuit 3 as the signal voltage V. The logical circuit part 10 is composed of an RS flip-flop 14 comprising four D flip-flops D1, D2, D3, D4, two NAND gates 14*a*, 14*b*, and one EX-OR gate 15, and has a function of generating a polarity inversion signal FR which switches, controls the switch of the above described inversion processing part 9 in accordance with a control signal C to be inputted from the input terminal 16, and a vertical synchronous signal VS to be inputted from the other input terminal 17.

Figure 4:
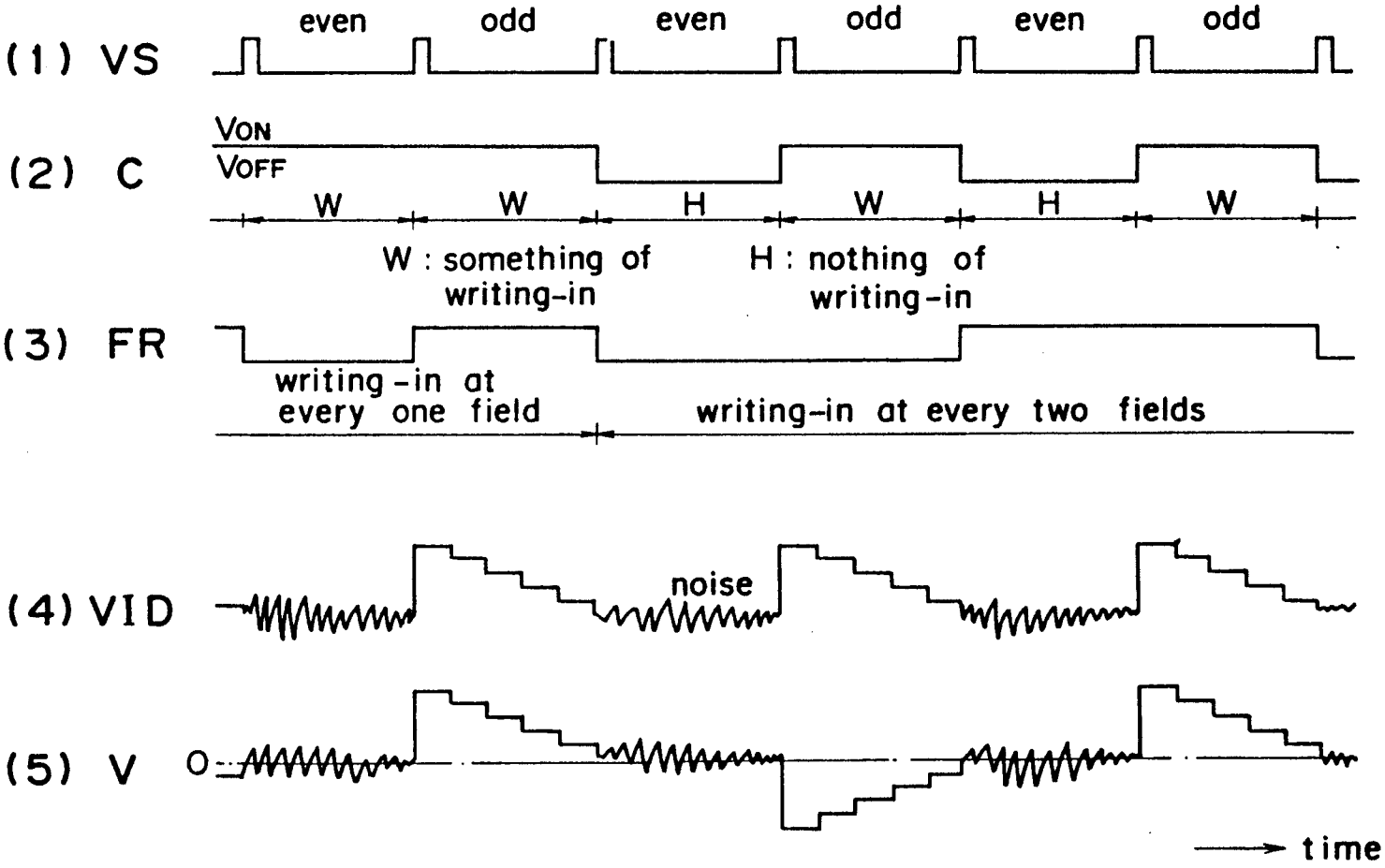
FIG. 4 is a timing chart showing one example of the operation of the display apparatus shown in FIG. 3.

FIG. 4 is a timing chart showing the operation of the liquid crystal display apparatus shown in FIG. 3. The operation of the above described liquid crystal display apparatus will be described hereinafter with reference to the timing chart.

The operation in this case is also assumed in a case where only either of the signal of the odd-number field or of the signal of the even-number field among the picture signals VID to be inputted is stored into the picture element (here only the signal of the odd-number field is stored) as in the case of the liquid crystal display apparatus shown in FIG. 1. The signal which becomes noisy in state in the even-number field is to be inputted into the input terminal 11 of the polarity inversion circuit 4 as shown in FIG. 4 (4) as the picture signal VID.

The vertical synchronizing signal VS is inputted as shown in FIG. 4 (1) into the input terminal 17 of the polarity inversion circuit 4 for each of the field head positions of the picture signal VID. The period of the vertical synchronizing signal VS is adjusted into the original repetition period of the scanning pulse to be applied upon the row electrode of the liquid crystal panel. 1.

When the control signal C shown in FIG. 4 (2) is a voltage Von of a high level through the even-number field and the odd-number field, the polarity inversion signal FR to be outputted from the logical circuit part 10 becomes a low level in the even-number field, and a high level in the odd-number field as shown in FIG. 4 as shown in FIG. 4 (3). Thus, in the inversion processing part 9, the picture signal VID inverted in polarity through the inversion amplifier 12*b* is selected in the even-number field as shown in FIG. 4 (5), while the picture signal VID which is not inverted in polarity through the non-inversion amplifier 12*a* is selected in the odd-number field, so as to transmit the selected signal as a signal voltage V into the column electrode driving circuit 3.

At this time, the scanning pulses are sequentially applied upon the respective row electrodes in the even-number field and in the odd-number field as shown in FIG. 4 (2), and the corresponding switching element becomes. Thus, the signal voltage V is applied upon the picture elements across the respective fields. Accordingly, the voltage to be applied upon the picture elements at this time does not become the AC rectangular waves, with the inversion signal in the noise state being applied in the even-number field, and the non-inversion signal free from the noises being applied in the odd-number field. Namely, the AC driving operation is largely interfered with.

On the other hand, the control signal C shown in FIG. 4 (2) changes in the period of the voltage Voff of the low level in the even-number field and in the period of the voltage Von of the high level in the odd-number field. The D flip-flop D2 of the logical circuit 10 starts its operation, so that the repetition period of the polarity inversion signal FR is switched from a period of two fields into a period of four fields. Namely, in the next even-number field and odd-number field, the polarity inversion signal FR becomes low in level so as to select the picture signal VID inverted in polarity through the inversion amplifier 12*b* across the two field portions as shown in FIG. 4 (5) in the inversion processing part 9, and the polarity inversion signal FR becomes high in level in the section of two fields of the further continuous even-number field and the odd-number field so as to select the picture signal VID which is not inverted in polarity through the non-inversion amplifier 12*a* across the section thereof as shown in FIG. 4 (5) in the inversion processing part 9.

At this time, the scanning pulse is not applied upon the row electrode in the even-number field as shown in FIG. 4 (2), but the scanning pulse is applied upon the row electrode only in the odd-number field. Thus, the inversion signal of the picture signal VID which is not noisy in state in the odd-number field is applied upon the corresponding picture element in the section of the first two fields, and the non-inversion signal of the picture signal VID which is not in the noisy state in the odd-number field is applied upon the corresponding picture elements in the section of the continuous two fields. Accordingly, the AC rectangular wave which is inverted in polarity is applied upon the picture elements for each two fields so that the AC driving operation is not interfered with. Since the picture signal VID, except for the wave form in the noisy state, is applied, the display quality of the images becomes improved.

Figure 5:
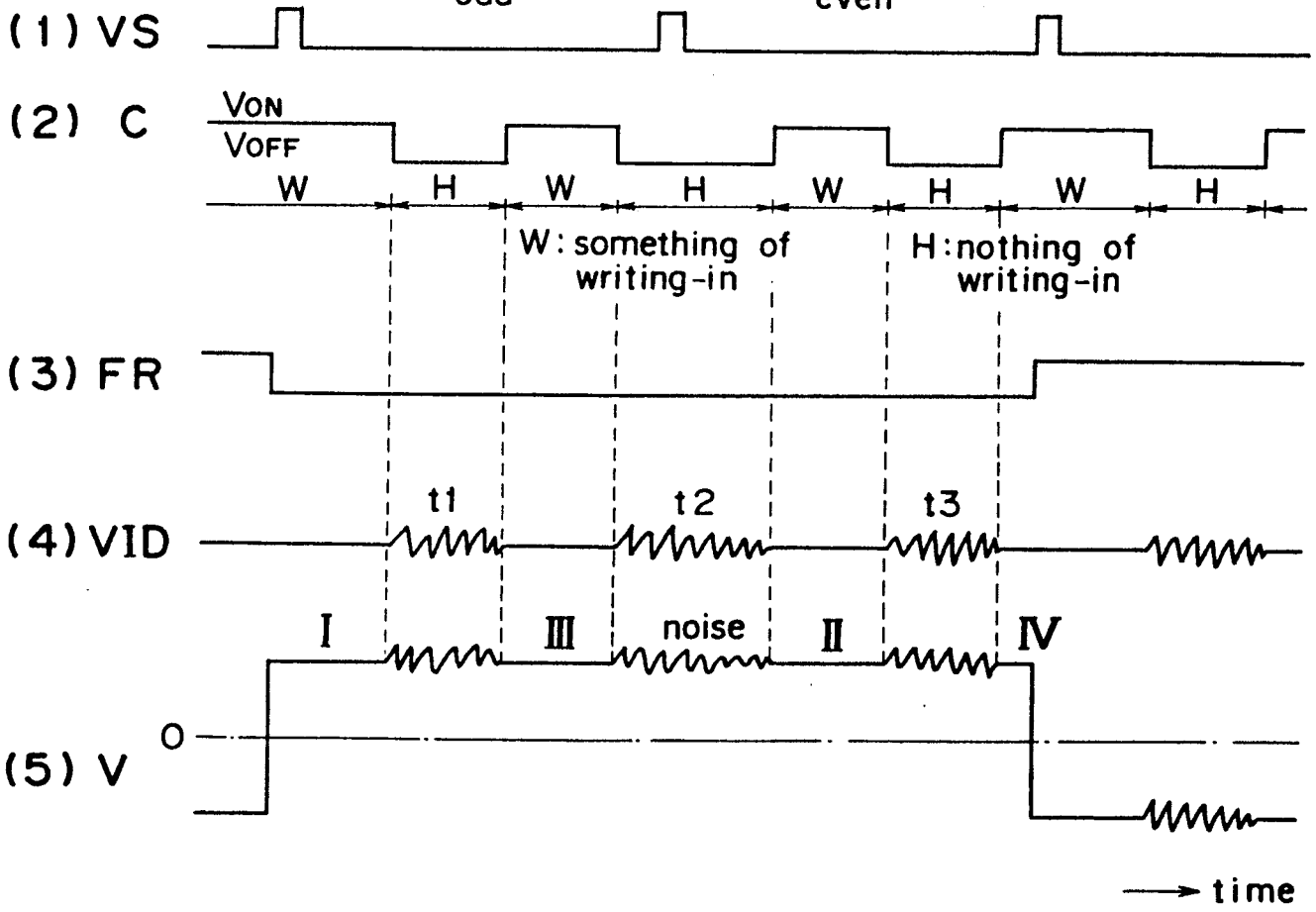
FIG. 5 is a timing chart showing another example of the operation of the display apparatus thereof.

FIG. 5 is a timing chart showing another exemplary embodiment of the operation of the liquid crystal display apparatus shown in FIG. 3.

The operation is assumed in a case where only the application of the scanning pulse to some of the row electrodes among the row electrodes of the liquid crystal panel 1 is periodically prohibited, and the picture signal VID to be inputted becomes noisy in the particular section within the respective fields.

Namely, when the picture signal VID is to be noisy in state (the section of the noise condition in the odd-number field corresponds to the section of the non-noise state in the even-number field) in the section t1 of the odd-number field, the section t2 extending from the odd-number field to the next even-number field, and the section t3 of the even-number field, the control signal C to be inputted into the row electrode driving circuit 2 and the polarity inversion circuit 4 is set to become the voltage Voff of the low level in the respective intervals t1, t2, t3, to become the voltage Von of the high level in the other section (the wave form of the odd-number field and the wave form of the even-number field become inverted mutually in level) as shown in FIG. 5 (2) so as to repeat the period.

Even in this case, the period of the polarity inversion signal FR to be outputted from the logical circuit part 10 of the polarity inversion circuit 4 becomes four fields as in a case of the operation shown in FIG. 4. The level becomes lower in the sections of two field portions of the first odd-number field and even-number field as shown in FIG. 5 (3), and the level becomes higher in the section of the continuous two field portions so as to repeat the period.

Accordingly, the signal voltage V to be fed into the row electrode driving circuit 3 from the polarity inversion circuit 4 becomes a picture signal VID which is not inverted in polarity in the section of the first two field portions, and becomes a picture signal VID inverted in polarity in the section of the continuous two field portions, so as to repeat the period.

Since the section of the noise state in the odd-number field and the section of the non-noise state in the even-number field among the respective two field portions are respectively set correspondingly, as described hereinabove, although only the signal voltage of the wave form portion free from the noise condition is applied upon the picture element as the application of the signal voltage V upon the picture element is not effected in the sections t1, t2, t3 among the sections of the respective two fields, the wave form portion which has not been applied upon the picture element in the odd-number field is applied without fail upon the picture element in the next even-number field. Further, the wave form portion which is not applied upon the picture element in the even-number field is applied upon the picture element without fail in the previous odd-number field. In this manner, the AC rectangular wave with the four fields being provided as the period is applied upon the respective picture elements.

Figure 6:
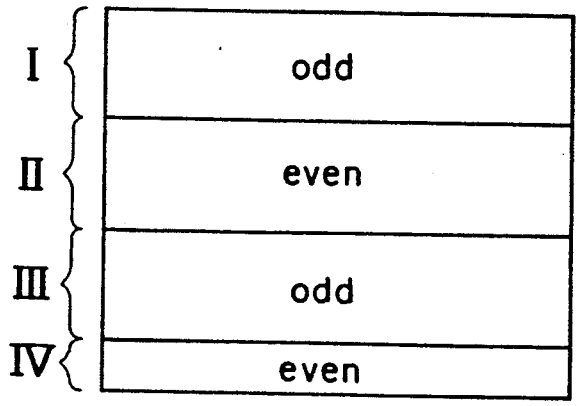
FIG. 6 is a model chart of the display picture to be obtained by the operation thereof.
Figure 7:
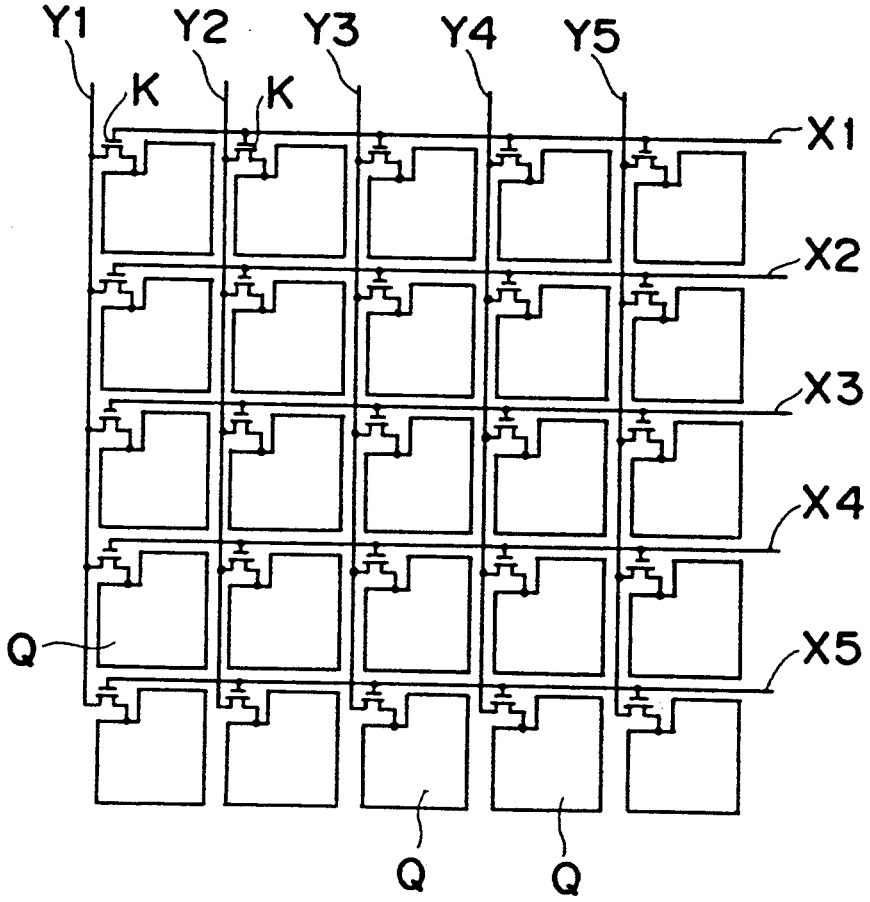
Fig. 7 PRIOR ART
FIG. 7 is an equivalent circuit diagram showing a schematic circuit structure of a liquid crystal panel in the liquid crystal display apparatus of the general active matrix driving system.
Figure 8:
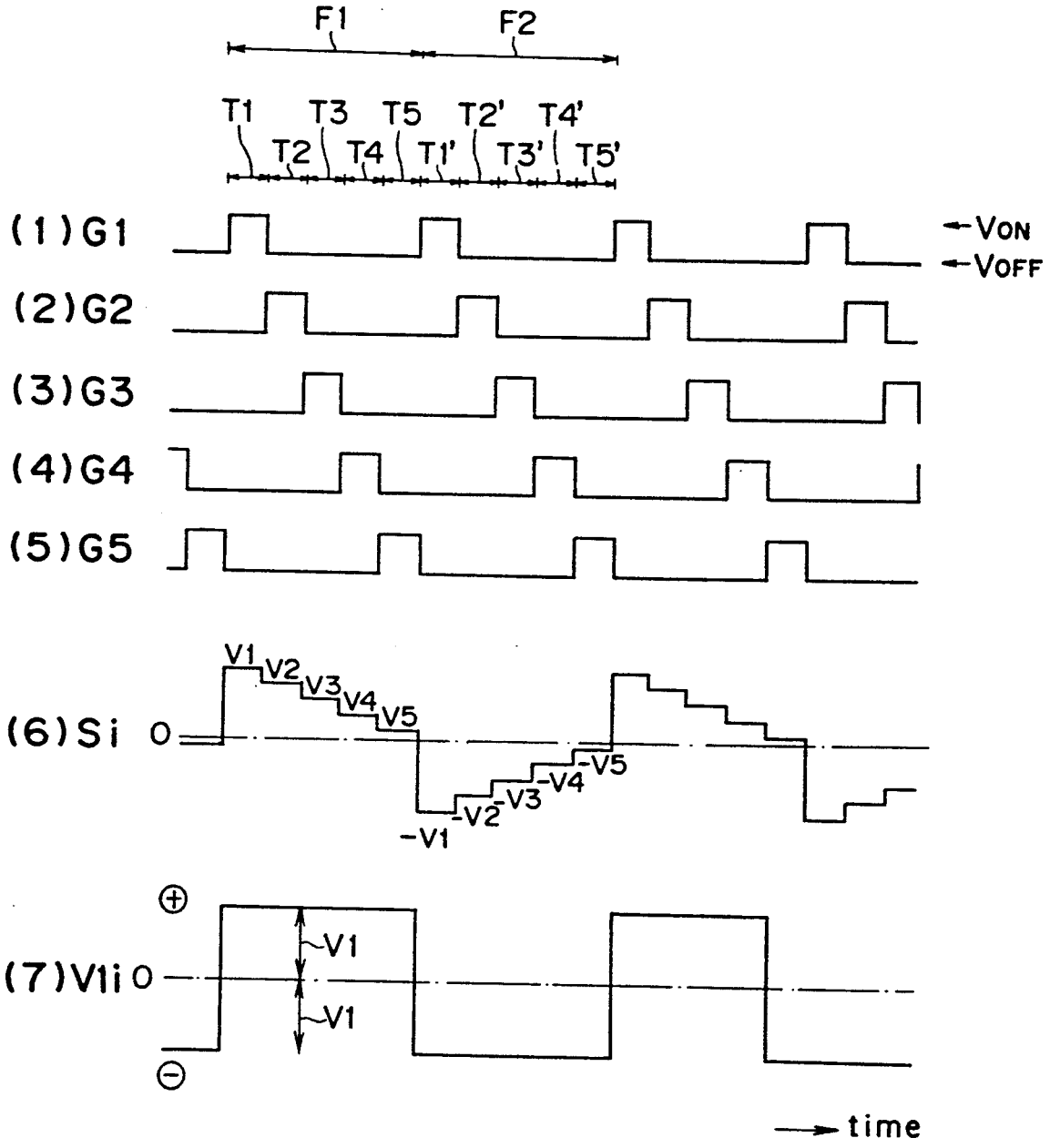
Fig. 8 PRIOR ART
FIG. 8 is a timing chart showing the operation of the liquid crystal display apparatus thereof.

FIG. 6 is a model chart showing the corresponding relation between the respective portions of the image shown in the liquid crystal panel 1 at this time and the field of the picture signal VID carrying the respective portions thereof.

Namely, the scanning section I of the topmost portion of the image in FIG. 6 is carried by the wave form portion before the section t1 of the odd-number field among the signal voltages V of FIG. 5 (5); the following scanning section II is carried by the wave form portion after the section t2 of the even number field among the signal voltages V of FIG. 5 (5); the following scanning section III is carried by the wave form portion before the section t2 in the odd-number field among the signal voltages V of FIG. 5 (5); furthermore the scanning section IV of the bottommost portion is carried by the wave form portion after the section t3 of the even-number field among the signal voltages V of FIG. 5 (5). Since one image is shown, with only the wave form portions in the respective non-noise states of the odd-number field and the even-number field in this manner, the images free from the noises may be provided.

Although a case where the repetition period of the scanning pulse becomes twice as many as the original period in any case is provided by way of example in the above described embodiment, the realization may be effected by the similar circuit construction even in a case of the period of two times or more. Since the frequency of the rectangular wave to be applied upon the liquid crystal becomes lower correspondingly when the repetition period of the scanning pulse exceeds two times, the new problem such as flicker and so on may be unrealistically caused.

Although a case where it has been applied to the liquid crystal display apparatus of an active matrix driving system in the above-described embodiment, it may be applied to the liquid crystal display apparatus of a dynamic driving system. Further it may be applied similarly even to the other display apparatus with the AC driving operation being effected, such as a thin membrane EL display apparatus, for example.

As is clear from the foregoing description, the display apparatus of the present invention is adapted to prohibit the application of the scanning voltage upon all the row electrodes or some of the row electrodes for a given period, so as to switch the repetition period of the scanning voltage to be applied on all row electrodes or the some of the row electrodes into the integral multiple of the original repetition period, and to switch the period of the polarity inversion of the driving voltage to be applied upon the picture element in accordance with the repetition period of the switched scanning voltage. Therefore, the complete AC driving operation may be effected, for example, even in a case where the signal voltage at the first repetition period of the scanning voltage is different from the signal voltage at the second repetition period.

Although the present invention has been fully described by way of example with reference to the accompanying drawings, it is to be noted here that various changes and modifications will be apparent to those skilled in the art. Therefore, unless such changes and modifications otherwise depart from the scope of the present invention, they should be construed as included therein.

What is claimed is:

1. A display apparatus including a plurality of row electrodes along each row of a plurality of picture elements arranged in a matrix shape, to which scanning voltages are sequentially applied, and a plurality of column electrodes along each column of the picture elements, to which signal voltages corresponding to display contents are applied in synchronous relation with the scanning voltages, so as to apply driving voltages corresponding to the display contents upon the respective picture elements, and an AC driving inversion device which inverts polarity of the driving voltage in synchronous operation with a first repetition period of the scanning voltage to be specified by a number of all the row electrodes, the display apparatus comprising:

means for prohibiting the application of the scanning voltage upon at least one of the row electrodes for a predetermined time period so as to switch the first repetition period of the scanning voltage to be applied on at least one of the row electrodes into a second repetition period which is an integral multiple of the first repetition period; and means for switching a period of the polarity inversion of the signal driving voltage in accordance with the second repetition period of the scanning voltages.

2. The display apparatus of claim 1, wherein the display apparatus is a liquid crystal device.

3. The display apparatus of claim 1, wherein the means for prohibiting prohibits the application of the scanning voltage to all of the row electrodes for the predetermined time period.

4. The display apparatus of claim 1, wherein the means for prohibiting includes an AND gate to which both a signal from a shift-register and a control signal are inputted, the control signal being the same signal which controls polarity inversion of the signal driving voltage.

5. The display apparatus of claim 1, wherein the switching means includes an inversion amplifier for inverting the polarity of the video signals, a non-inversion amplifier, and a switch for selecting an output of either of the amplifiers for subsequent input of a video signal being varied in polarity inversion period, to a row electrodes driving circuit.

6. The display apparatus of claim 5, wherein the switch means selects an output of either of the amplifiers based upon a control signal output from a logic circuit which provides an inversion operation timing to control polarity inversion of the signal voltage and to prohibit loading of the scanning voltage to the scanning electrodes.

7. A display driving apparatus for a display including a plurality of row electrodes, a plurality of column electrodes arranged perpendicular to the plurality of row electrodes, and a plurality of picture elements, each arranged at a row and column electrode intersection, the driving apparatus comprising:

first drive means, operatively connected to the plurality of the row electrodes, for sequentially applying a scanning voltage, after a predetermined period, to each of the plurality of row electrodes;

second drive means, operatively connected to the plurality of column electrodes, for applying a signal voltage, corresponding to data to be displayed, to each of the plurality of column electrodes in synchronous relation with the scanning voltage;

inversion means, operatively connected to the second drive means, for inverting polarity of an input data signal corresponding to data to be displayed, during alternating periods, each period being of a varying repetition period equal to an integral multiple of the predetermined period for application of the scanning voltage; and controlling means, operatively connected to the first drive means, for inhibiting the first drive means from applying a scanning voltage to at least one of the plurality of row electrodes during said varying repetition period of the inversion means, wherein the input data signal includes data and non-data portions, both occurring during the predetermined period, the controlling means inhibiting the first drive means during half of the predetermined period corresponding to the non-data portions.

8. The display driving apparatus of claim 7, wherein the display apparatus is a liquid crystal display.

9. The display driving apparatus of claim 7, wherein the controlling means is further operatively connected to the inversion means such that it controls inversion of the input data signal during alternating periods.

10. The display driving apparatus of claim 7, wherein the controlling means inhibits the first drive means from applying voltage to all of the plurality of row electrodes during half of the predetermined period.

11. The driving display apparatus of claim 7, wherein the input data signal, during each of the alternating periods contains data to be displayed during each period, said first drive means being uninhibited during each predetermined period during which said input signal contains data to be displayed.

* * * * *